US009905144B2

(12) United States Patent
Lin et al.

(10) Patent No.: US 9,905,144 B2
(45) Date of Patent: Feb. 27, 2018

(54) LIQUID CRYSTAL DISPLAY AND TEST CIRCUIT THEREOF

(71) Applicant: AU Optronics Corp., Hsin-Chu (TW)

(72) Inventors: Nan-Ying Lin, Hsin-Chu (TW); Chung-Lin Fu, Hsin-Chu (TW); Yu-Hsin Ting, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 167 days.

(21) Appl. No.: 14/710,605

(22) Filed: May 13, 2015

(65) Prior Publication Data

US 2016/0155403 A1 Jun. 2, 2016

(30) Foreign Application Priority Data

Nov. 27, 2014 (TW) ..... 103141268 A

(51) Int. Cl.
*G09G 3/00* (2006.01)
*G09G 3/36* (2006.01)

(52) U.S. Cl.
CPC ..... *G09G 3/006* (2013.01); *G09G 3/36* (2013.01); *G09G 2330/12* (2013.01)

(58) Field of Classification Search
CPC .. G09G 3/006; G09G 3/3696; G09G 2320/02; G09G 3/36; G09G 3/00; G02F 2001/136254; G02F 1/13
See application file for complete search history.

(56) References Cited

U.S. PATENT DOCUMENTS 5,994,916 A * 11/1999 Hayashi ..... G02F 1/1309 324/500
2005/0093463 A1* 5/2005 Jang ..... H05B 41/2853 315/160
2009/0160478 A1* 6/2009 Lee ..... G09G 3/006 324/760.01
2012/0119776 A1* 5/2012 Dong ..... G09G 3/006 324/760.02

(Continued)

FOREIGN PATENT DOCUMENTS

CN 102385828 A 3/2012
TW 191943 10/1992

(Continued)

*Primary Examiner* — Son Le
*Assistant Examiner* — Akm Zakaria
(74) *Attorney, Agent, or Firm* — Locke Lord LLP; Tim Tingkang Xia, Esq.

(57) ABSTRACT

A liquid crystal display and a test circuit thereof are provided. The test circuit has a plurality of signal pads, a first data distributor, a plurality of logic circuit units and N switches. N is a positive integer. The signal pads are configured to receive a test data signal, a voltage signal, an enable signal and a plurality of first switch control signals. The first data distributor distributes the test data signal to N output terminals of the first data distributor. Each of the logic circuit units generates a second switch control signal according to the voltage signal, the enable signal and a corresponding one of the first switch control signals. Each of the switches controls the electrical connection between an output terminal of the first data distributor coupled thereto and at least a data line coupled thereto.

12 Claims, 10 Drawing Sheets

(56) References Cited

U.S. PATENT DOCUMENTS

| | | | | |
|---|---|---|---|---|
| 2012/0162165 | A1* | 6/2012 | Lee | G09G 3/006 345/206 |
| 2014/0009375 | A1* | 1/2014 | Tsai | G09G 3/36 345/98 |
| 2015/0091885 | A1* | 4/2015 | Cheng | G09G 3/3677 345/208 |

FOREIGN PATENT DOCUMENTS

| | | | |
|---|---|---|---|
| TW | I276037 | | 3/2007 |
| TW | 201307945 | A1 | 2/2013 |
| TW | 201409044 | A | 3/2014 |

* cited by examiner

LIQUID CRYSTAL DISPLAY AND TEST CIRCUIT THEREOF

BACKGROUND OF THE INVENTION

1. Field of the Invention

The present invention is related to a liquid crystal display (LCD) and a test circuit thereof, and more particularly, to a narrow bezel LCD and a test circuit thereof.

2. Description of the Prior Art

Liquid crystal displays (LCDs) are the most popular displays nowadays. Due to the continuous improvement in the technologies of manufacture, the yield of display panel of the LCD is increased accordingly. However, the yield of display panel is still below 100%. For the sake of the yield, a test mechanism would be added during manufacturing the display panel of the LCD so as to increase the yield.

Please refer to FIG. 1. FIG. 1 is a schematic diagram of a liquid crystal display 100 of the prior art. The LCD 100 has a substrate 110, a test circuit 120, a pixel array 140 and a source driving circuit 150. The test circuit 120, the pixel array 140 and the source driving circuit 150 are positioned on the substrate 110. The pixel array 140 has a plurality of pixels for displaying images, and the area on which the pixel array 140 is located is generally named an "Active Area (AA)". The test circuit 120 and the source driving circuit 150 are positioned within an outer lead bonding (OLB) area of the substrate 110. The source driving circuit 150 is configured to drive the pixels of the pixel array 140, and the test circuit 120 has a plurality of signal pads for receiving test signals and is configured to perform array tests. However, since both of the test circuit 120 and the source driving circuit 150 are positioned within the OLB area of the substrate 110, such arrangement is unfavorable for designing a narrow bezel LCD.

SUMMARY OF THE INVENTION

An embodiment of the present invention provides test circuit of a liquid crystal display (LCD). The test circuit comprises a plurality of signal pads, a first data distributor, a plurality of logic circuit units and N switches. N is a positive integer. The signal pads are configured to receive a test data signal, a voltage level signal, an enable signal and a plurality of first switch control signals. The first data distributor is coupled to the signal pads and configured to selectively distribute the test data signal to N output ends of the first data distributor. The logic circuit units are coupled to the signal pads. Each of the logic circuit units is configured to generate a second switch control signal according to the voltage level signal, the enable signal and a corresponding one of the first switch control signals received from the signal pads. Each of the switches is coupled between one of the output ends of the first data distributor and at least a data line of the LCD and configured to control electric connection between the output end and the at least a data line coupled thereto according to the second switch control signal, which is generated by a corresponding one of the logic circuit units.

An embodiment of the present invention provides a liquid crystal display (LCD). The LCD comprises a substrate, a pixel array, a test circuit and a source driving circuit. The pixel array is formed on the substrate and comprises a plurality of pixels and a plurality of data lines coupled to the pixels. The test circuit comprises a plurality of signal pads, a first data distributor, a plurality of logic circuit units and N switches. N is a positive integer. The signal pads are configured to receive a test data signal, a voltage level signal, an enable signal and a plurality of first switch control signals. The first data distributor is coupled to the signal pads and configured to selectively distribute the test data signal to N output ends of the first data distributor. The logic circuit units are coupled to the signal pads. Each of the logic circuit units is configured to generate a second switch control signal according to the voltage level signal, the enable signal and a corresponding one of the first switch control signals received from the signal pads. Each of the switches is coupled between one of the output ends of the first data distributor and at least a data line of the LCD and configured to control electric connection between the output end and the at least a data line coupled thereto according to the second switch control signal, which is generated by a corresponding one of the logic circuit units. The source driving circuit is configured to generate operational data signals and output the operational data signals to the pixels.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
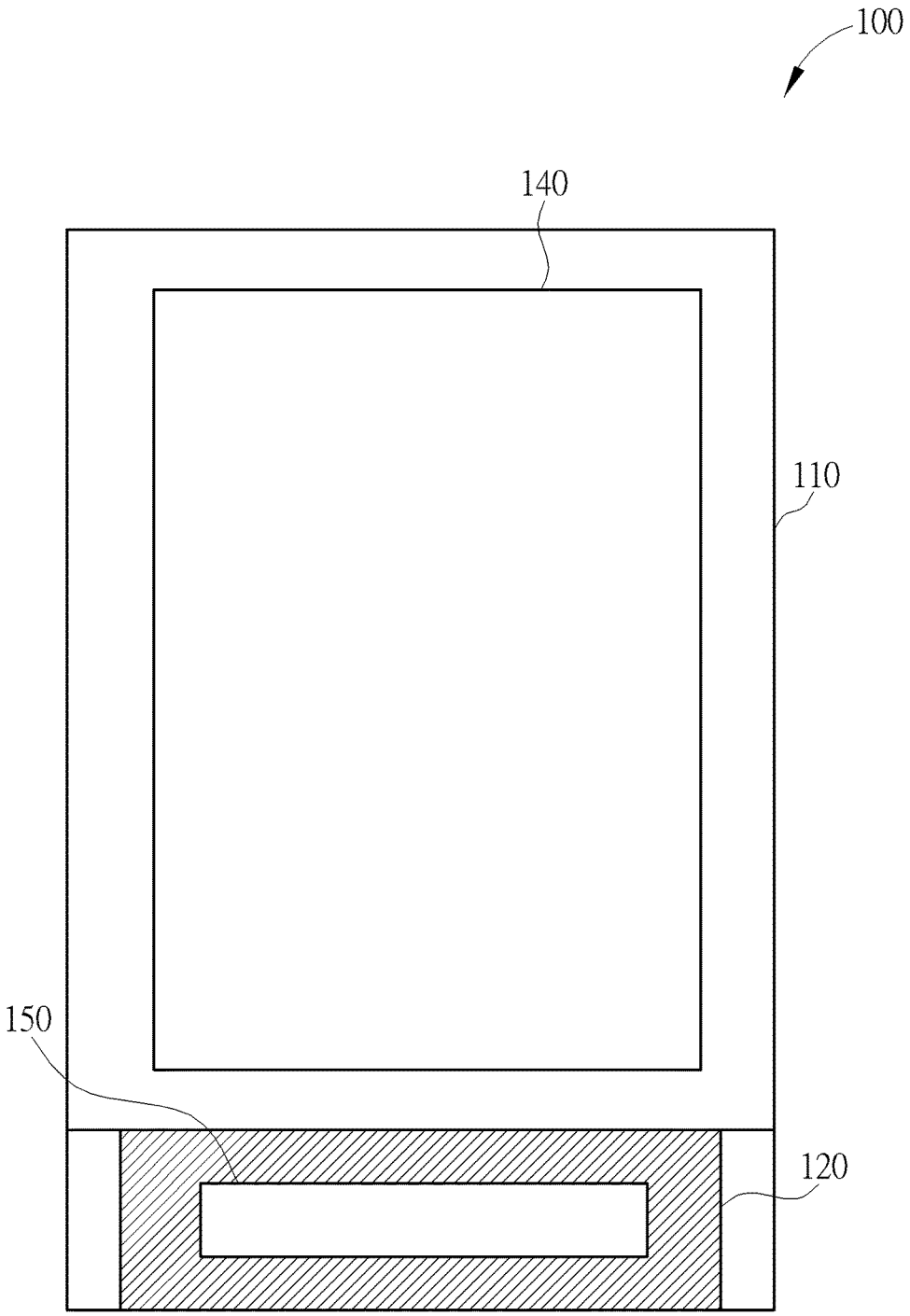
FIG. 1 PRIOR ART
FIG. 1 is a schematic diagram of a liquid crystal display of the prior art.
Figure 2:
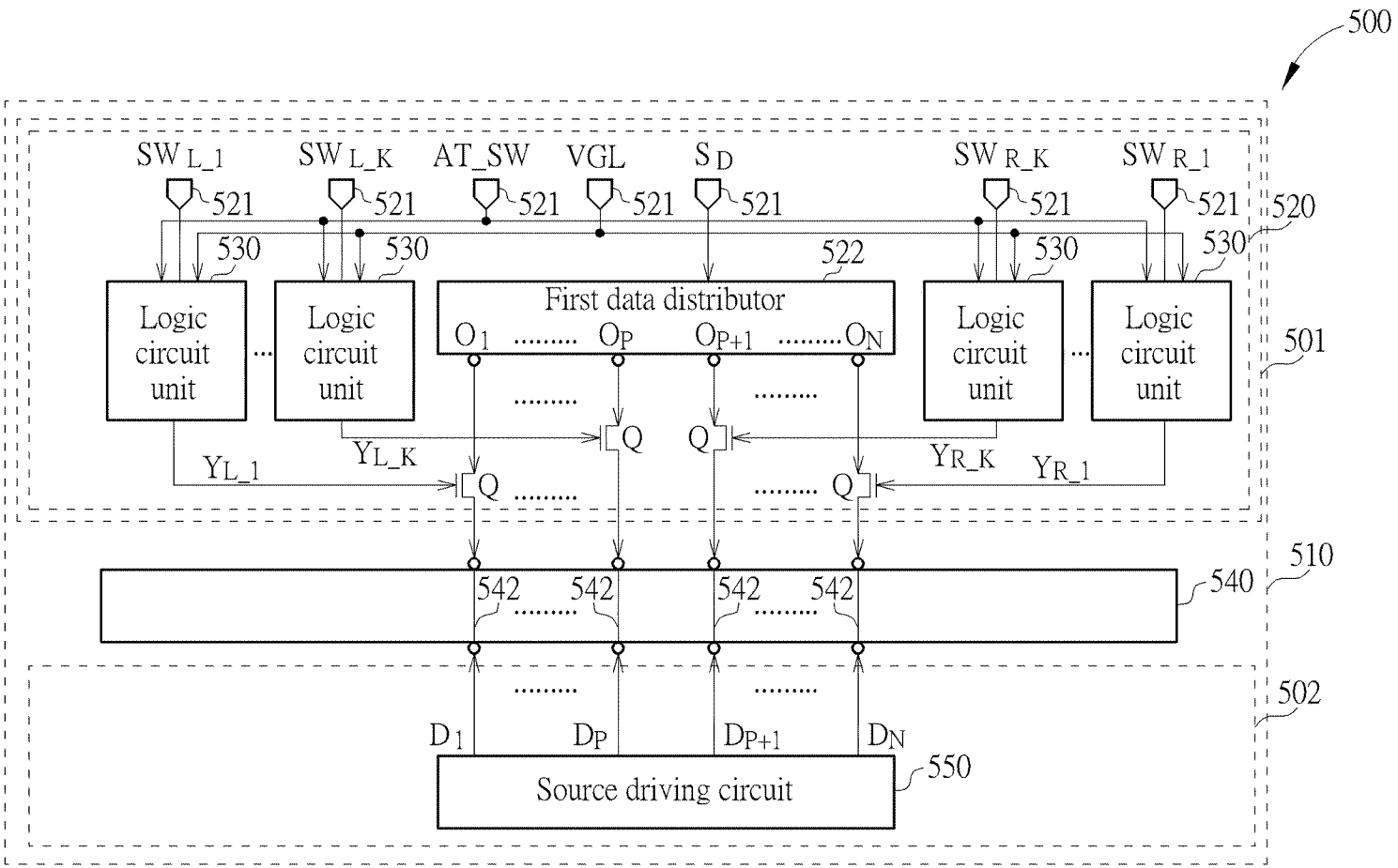
FIG. 2 is a schematic diagram of a liquid crystal display according to an embodiment of the present invention.
Figure 3:
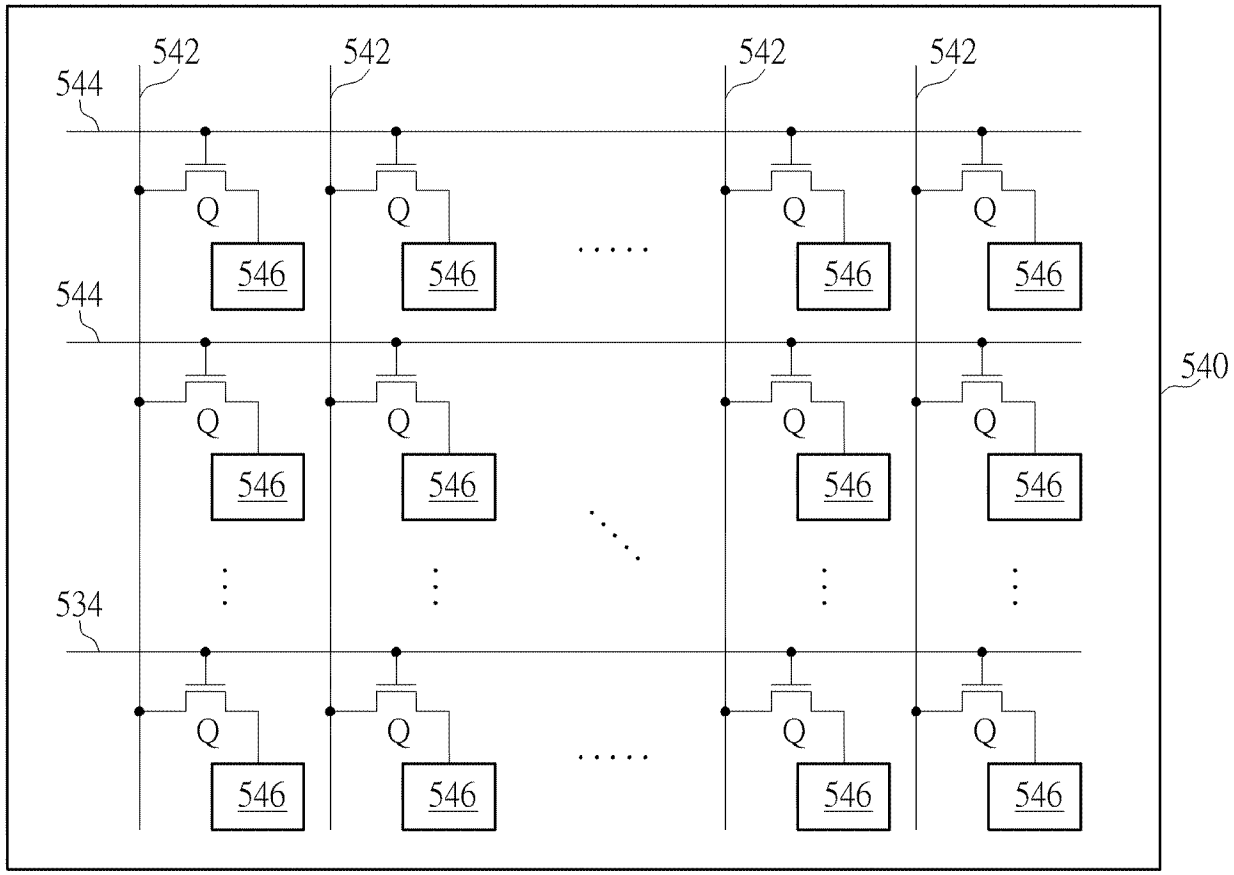
FIG. 3 is a circuit diagram of a pixel array of the LCD in FIG. 2.

Please refer to FIGS. 2 and 3. FIG. 2 is a schematic diagram of a liquid crystal display (LCD) 500 according to an embodiment of the present invention, and FIG. 3 is a circuit diagram of a pixel array 540 of the LCD 500. The LCD 500 comprises a substrate 510, a test circuit 520, the pixel array 540 and a source driving circuit 550. The test circuit 520 is positioned within a first area 501 of the substrate 510, the source driving circuit 550 is positioned within a second area 502 of the substrate 510, and the pixel array 540 is positioned between the first area 501 and the second area 502. The pixel array 540 is formed on the substrate 510 and comprises a plurality of pixels 546, a plurality of data lines 542 and a plurality of scan lines 544. The pixels 546 are arranged as an array and configured to display images. Each of the pixels 546 is coupled to a corresponding one of the data lines 542 and a corresponding one of the scan lines 544.

The test circuit 520 has a plurality of signal pads 521, a first data distributor 522, a plurality of logic circuit units 530 and N switches Q. N is a positive integer. The signal pads 521 are configured to receive a test data signal $S_D$, a voltage level signal VGL, an enable signal AT_SW and a plurality of first switch control signals $SW_{L_1}$ to $SW_{L_K}$ and $SW_{R_1}$ to $SW_{R_K}$. The first data distributor 522 is coupled to the signal pads 521 and configured to selectively distribute the test data signal $S_D$ to N output ends $O_1$ to $O_N$ of the first data distributor 522. The logic circuit units 530 are coupled to the signal pads 521. Each of the logic circuit units 530 is configured to generate one of second switch control signals $Y_{L_1}$ to $YW_{L_K}$ and $Y_{R_1}$ to $Y_{R_K}$ according to the voltage level signal VGL, the enable signal AT_SW and a corresponding one of the first switch control signals $SW_{L_1}$ to $SW_{L_K}$ and $SW_{R_1}$ to $SW_{R_K}$, which is received from the signal pads 521. Each of the switches Q is coupled between one of the output ends $O_1$ to $O_N$ of the first data distributor 522 and at least a data line 542 of the pixel array 540 and is configured to control electric connection between the output end (i.e. one of the output ends $O_1$ to $O_N$) and the at least a data line 542 coupled thereto according to the second switch control signal (i.e. one of the second switch control signals $Y_{L_1}$ to $YW_{L_K}$ and $Y_{R_1}$ to $Y_{R_K}$), which is generated by the corresponding one of the logic circuit units 530. When any switch Q is turned on, the pixels 546 coupled to the turned-on switch Q would be tested by the test circuit 520. Although each of the switches Q is coupled to a single data line 542 in the present invention, the present invention is not limited thereto. In other words, each of the switches Q may be coupled to multiple data lines 542 such that the pixels 546 coupled to the multiple data lines 542 would be tested simultaneously even if a single switch Q is turned on.

Moreover, the source driving circuit 550 is configured to generate operational data signals $D_1$ to $D_N$ and output the operational data signals $D_1$ to $D_N$ to the pixels 546 via the data lines 542. It is noted that the operations of the source driving circuit 550 do not conflict with the operations of the test circuit 520 because the test circuit 520 performs array tests on the thin film transistors of the LCD 500 during manufacturing the LCD 500 and would be disabled while the manufacture of the LCD 500 is finished. Moreover, the source driving circuit 550 is configured to generate the operational data signals $D_1$ to $D_N$ after the manufacture of the LCD 500 is done. For the aforesaid reasons, the operations of the source driving circuit 550 do not conflict with the operations of the test circuit 520.

Figure 4:
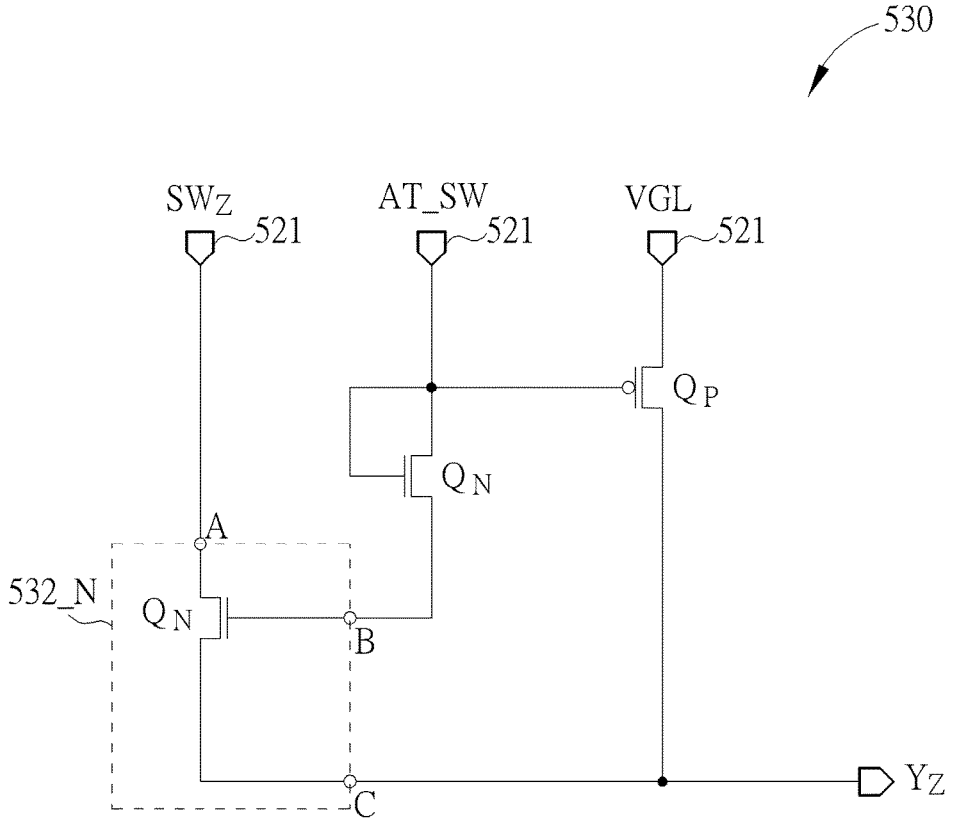
FIGS. 4 to 7 respectively illustrate a circuit diagram of a logic circuit unit according to different embodiments of the present invention.

Please refer to FIG. 4. FIG. 4 is a circuit diagram of the logic circuit unit 530 according to an embodiment of the present invention. The logic circuit unit 530 has a switch unit 532_N, an NPN-type transistor $Q_N$ and a PNP-type transistor $Q_P$. In the embodiment, the switch unit 532_N comprises another NPN-type transistor $Q_N$. The logic circuit unit 530 is coupled to three signal pads 521, and the three signal pads 521 respectively receive a first switch control signal $SW_Z$, the enable signal AT_SW and the voltage level signal VGL. Wherein, the first switch control signal $SW_Z$ is one of the first switch control signals $SW_{L_1}$ to $SW_{L_K}$ and $SW_{R_1}$ to $SW_{R_K}$. The logic circuit unit 530 generates a second switch control signal $Y_Z$ according to the received first switch control signal $SW_Z$, the enable signal AT_SW and the voltage level signal VGL. Wherein, second switch control signal $Y_Z$ is one of the second switch control signals $Y_{L_1}$ to $Y_{L_K}$ and $Y_{R_1}$ to $Y_{R_K}$, and the second switch control signal $Y_Z$ and first switch control signal $SW_Z$ are corresponding to each other. The truth table of the logic circuit unit 530 is table 1 as represented below:

TABLE 1

| $SW_z$ | AT_SW | VGL | $Y_z$ |
|---|---|---|---|
| 0 | 0 | 0 | 0 |
| 0 | 0 | 1 | 1 |
| 0 | 1 | 0 | 0 |
| 0 | 1 | 1 | 0 |
| 1 | 0 | 0 | 0 |
| 1 | 0 | 1 | 1 |
| 1 | 1 | 0 | 1 |
| 1 | 1 | 1 | 1 |

The table 1 may be simplified as table 2 as below:

TABLE 2

| $SW_z$ | AT_SW | VGL | $Y_z$ |
|---|---|---|---|
| X | 0 | X | VGL |
| X | 1 | X | $SW_z$ |

The symbol X in table 2 indicates that the corresponding signal is regarded as a "don't care" input. According to table 2, when the value of the enable signal AT_SW is "0", the value of the second switch control signal $Y_Z$ is equal to the value of the voltage level signal VGL; and when the value of the enable signal AT_SW is "1", the value of the second switch control signal $Y_Z$ is equal to the value of the first switch control signal $SW_Z$. Moreover, because the voltage level signal VGL is generally at a gate low voltage, and the gate low voltage is the voltage level of the gate lines that are in a non-scanned state, the table 2 would be further simplified as table 3 as below:

TABLE 3

| $SW_z$ | AT_SW | VGL | $Y_z$ |
|---|---|---|---|
| X | 0 | 0 | 0 |
| X | 1 | 0 | $SW_z$ |

Based on table 3, when the value of the enable signal AT_SW is "1", the second switch control signal $Y_Z$ output from the logic circuit unit 530 is the first switch control signal $SW_Z$. Therefore, when the values of the enable signal AT_SW and the first switch control signal $SW_Z$ are "1", the switch Q coupled to the logic circuit unit 530 is turned on, and the tests of the pixels 546 coupled to the switch Q are allowed.

Figure 5:
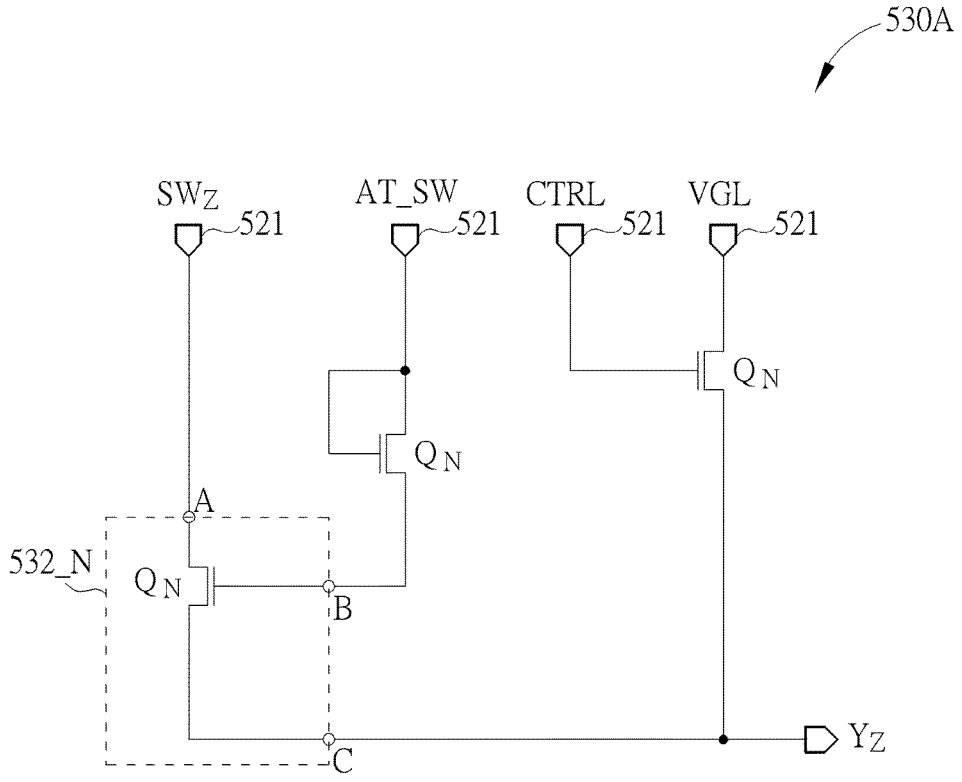

Please refer to FIG. 5. FIG. 5 is a circuit diagram of a logic circuit unit 530A according to another embodiment of the present invention. The logic circuit unit 530A comprises a switch unit 532_N and two NPN-type transistors $Q_N$. In the embodiment, the switch unit 532_N comprises another NPN-type transistor $Q_N$. The four signals pads 521 coupled to the logic circuit unit 530A respectively receive the first switch control signal $SW_Z$, the enable signal AT_SW, the control signal CTRL and the voltage level signal VGL. The logic circuit unit 530A outputs the second switch control signal $Y_Z$ according to the first switch control signal $SW_Z$, the enable signal AT_SW, the control signal CTRL and the voltage level signal VGL received from the signals pads 521. A simplified truth table of the logic circuit unit 530A is table 4 as represented below:

TABLE 4

| $SW_z$ | AT_SW | CTRL | VGL | $Y_z$ |
|---|---|---|---|---|
| X | 1 | 0 | 0 | $SW_z$ |
| X | 0 | 1 | 0 | 0 |

According to table 4, when the value of the enable signal AT_SW is "1" and the value of the control signal CTRL is "0", the second switch control signal $Y_Z$ output from the logic circuit unit 530A is the first switch control signal $SW_Z$. Therefore, when the values of the enable signal AT_SW and the first switch control signal $SW_Z$ are "1" and the value of the control signal CTRL is "0", the switch Q coupled to the logic circuit unit 530A is turned on, and the tests of the pixels 546 coupled to the switch Q are allowed.

Figure 6:
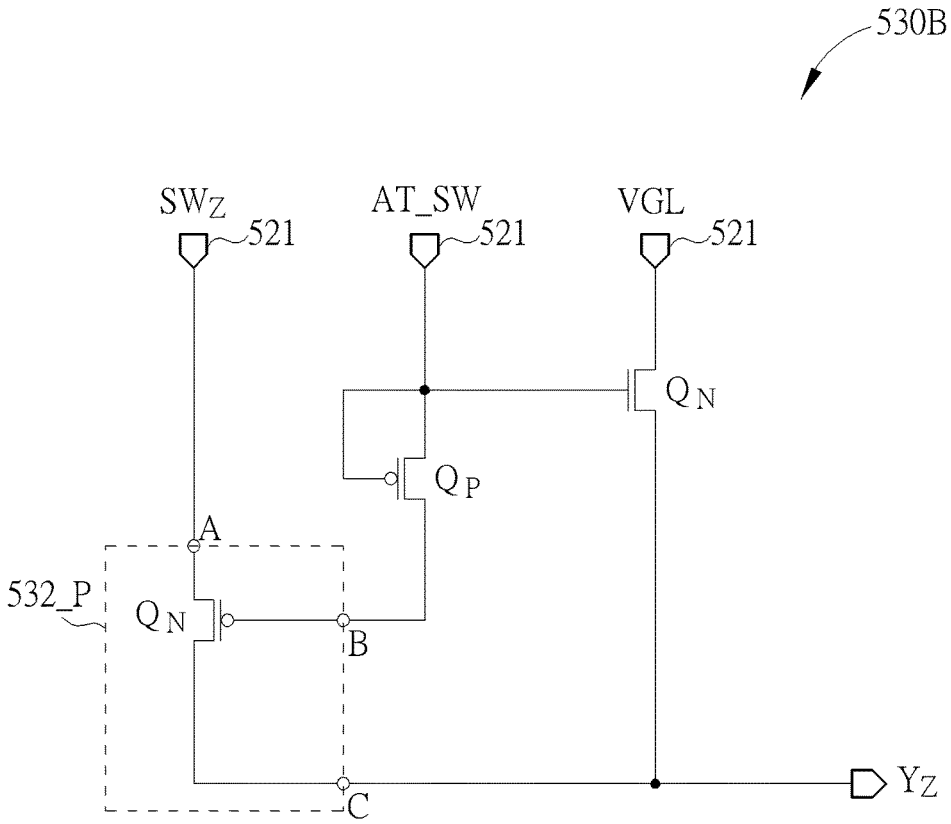

Please refer to FIG. 6. FIG. 6 is a circuit diagram of a logic circuit unit 530B according to another embodiment of the present invention. The logic circuit unit 530B comprises a switch unit 532_P, a PNP-type transistor $Q_P$ and a NPN-type transistor $Q_N$. In the embodiment, the switch unit 532_P comprises another PNP-type transistor $Q_P$. The three signals pads 521 coupled to the logic circuit unit 530B respectively receive the first switch control signal $SW_Z$, the enable signal AT_SW and the voltage level signal VGL. The logic circuit unit 530B outputs the second switch control signal $Y_Z$ according to the first switch control signal $SW_Z$, the enable signal AT_SW and the voltage level signal VGL received from the signals pads 521. A simplified truth table of the logic circuit unit 530B is table 5 as represented below:

TABLE 5

| $SW_z$ | AT_SW | VGL | $Y_z$ |
|---|---|---|---|
| X | 0 | 0 | $SW_z$ |
| X | 1 | 0 | 0 |

According to table 5, when the value of the enable signal AT_SW is "0", the second switch control signal $Y_Z$ output from the logic circuit unit 530B is the first switch control signal $SW_Z$. Therefore, when the value of the enable signal AT_SW is "0" and the value of the first switch control signal $SW_Z$ is "1", the switch Q coupled to the logic circuit unit 530B is turned on, and the tests of the pixels 546 coupled to the switch Q are allowed.

Figure 7:
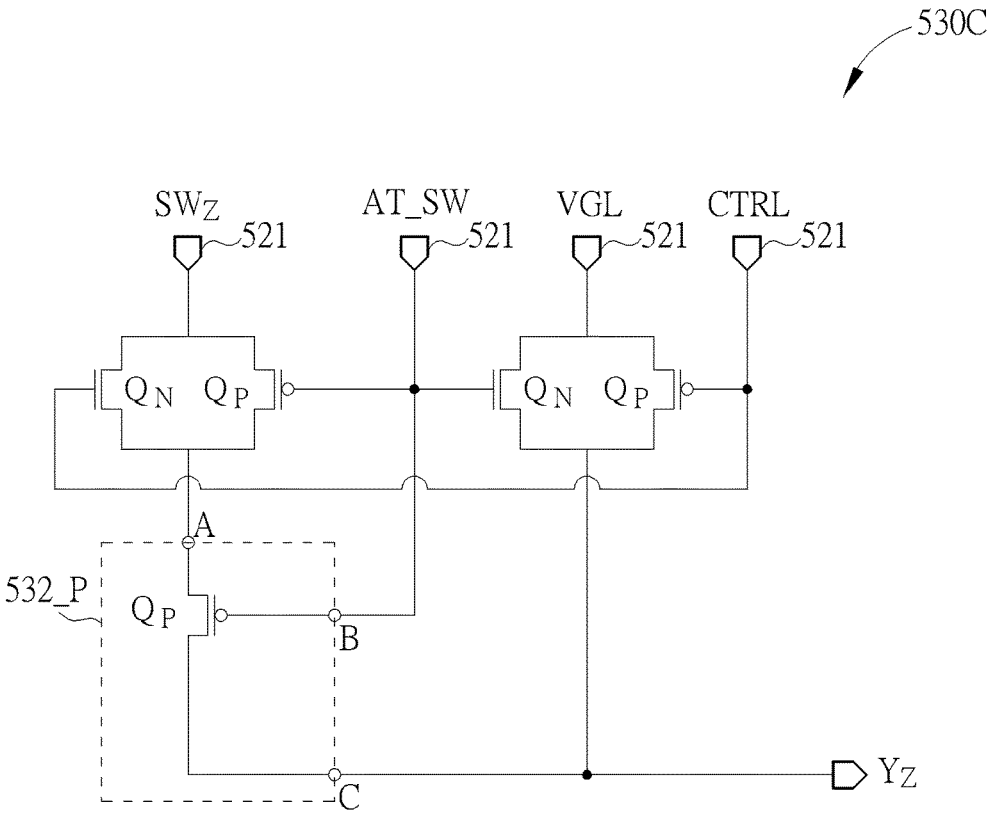
Figure 8A:
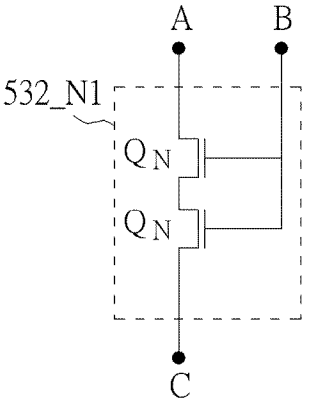
FIGS. 8A to 8E and 9A to 9E respectively illustrate a circuit diagram of a switch unit according to different embodiments of the present invention.
Figure 8B:
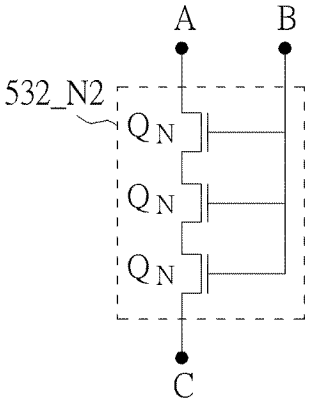
Figure 8C:
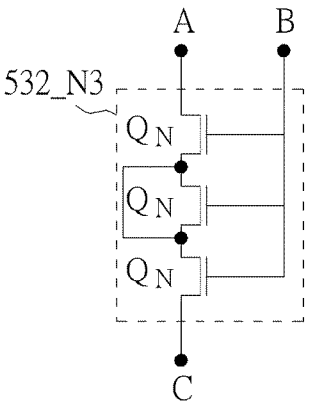
Figure 8D:
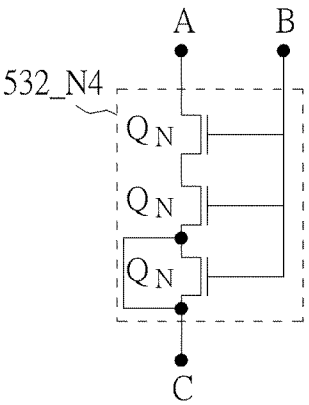
Figure 8E:
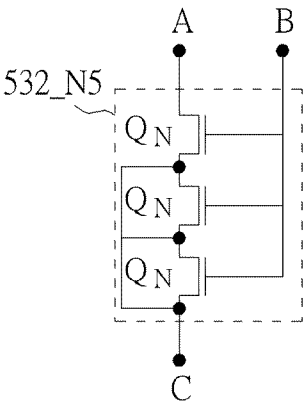
Figure 9A:
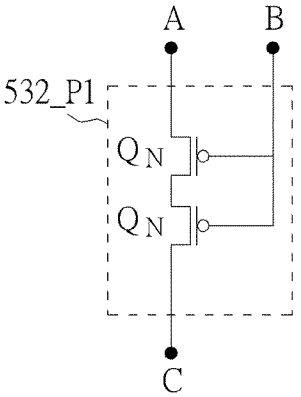
Figure 9B:
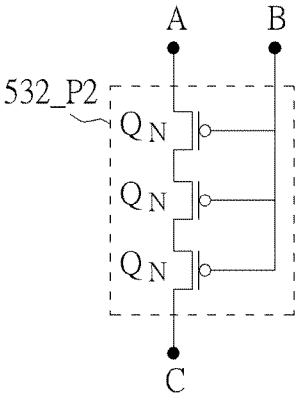
Figure 9C:
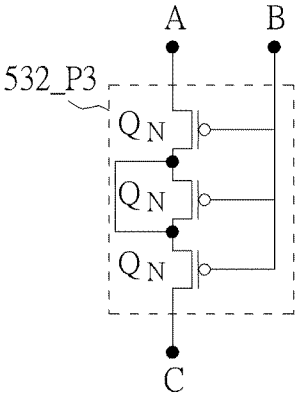
Figure 9D:
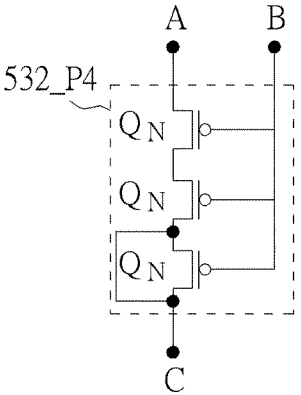
Figure 9E:
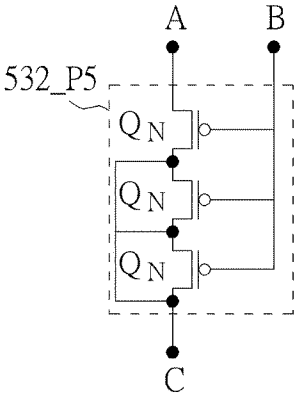

Please refer to FIG. 7. FIG. 7 is a circuit diagram of a logic circuit unit 530C according to another embodiment of the present invention. The logic circuit unit 530C comprises a switch unit 532_P, two NPN-type transistors $Q_N$ and two PNP-type transistors $Q_P$. In the embodiment, the switch unit 532_P comprises another PNP-type transistor $Q_P$. The four signals pads 521 coupled to the logic circuit unit 530C respectively receive the first switch control signal $SW_Z$, the enable signal AT_SW, the control signal CTRL and the voltage level signal VGL. The logic circuit unit 530C outputs the second switch control signal $Y_Z$ according to the first switch control signal $SW_Z$, the enable signal AT_SW, the control signal CTRL and the voltage level signal VGL received from the signals pads 521. A simplified truth table of the logic circuit unit 530C is table 6 as represented below:

TABLE 6

| $SW_z$ | AT_SW | CTRL | VGL | $Y_z$ |
|---|---|---|---|---|
| X | 1 | 0 | 0 | 0 |
| X | 0 | 1 | 0 | $SW_z$ |

According to table 6, when the value of the enable signal AT_SW is "0" and the value of the control signal CTRL is "1", the second switch control signal $Y_Z$ output from the logic circuit unit 530C is the first switch control signal $SW_Z$. Therefore, when the value of the enable signal AT_SW is "0" and the value of the control signal CTRL and the first switch control signal $SW_Z$ are "1", the switch Q coupled to the logic circuit unit 530C is turned on, and the tests of the pixels 546 coupled to the switch Q are allowed.

Moreover, since there is no wire routing from the first area 501 to the second area 502, the pixels 546 of the pixel array 540 would operate normally even if the width to length ratio (i.e. W/L) of the switches Q is not increased painstakingly. Therefore, the bezels of the LCD located between the first area 501 and the second area 502 would be narrowed, and each switch Q according to the present invention has a smaller layout area as compared to the prior art.

In addition, a number of the transistors of each of the switch units 532_N and 532_P may increase to improve the ability of the logic circuit units 530 and 530A to 530C for driving the pixels 546. For example, the switch unit 532_N may be replaced by any one of the switch units 532_N1 to 532_N5 shown in FIGS. 8A to 8E, and the switch unit 532_P may be replaced by any one of the switch units 532_P1 to 532_P5 shown in FIGS. 9A to 9E. Wherein, the nodes A, B and C of the switch unit 532_N respectively correspond to the nodes A, B and C of the switch units 532_N1 to 532_N5, and the nodes A, B and C of the switch unit 532_P respectively correspond to the nodes A, B and C of the switch units 532_P1 to 532_P5. Moreover, each of the switch units 532_N1 to 532_N5 comprises a plurality of NPN-type transistors $Q_N$, and each of the switch units 532_P1 to 532_P5 comprises a plurality of PNP-type transistors $Q_P$.

Figure 10:
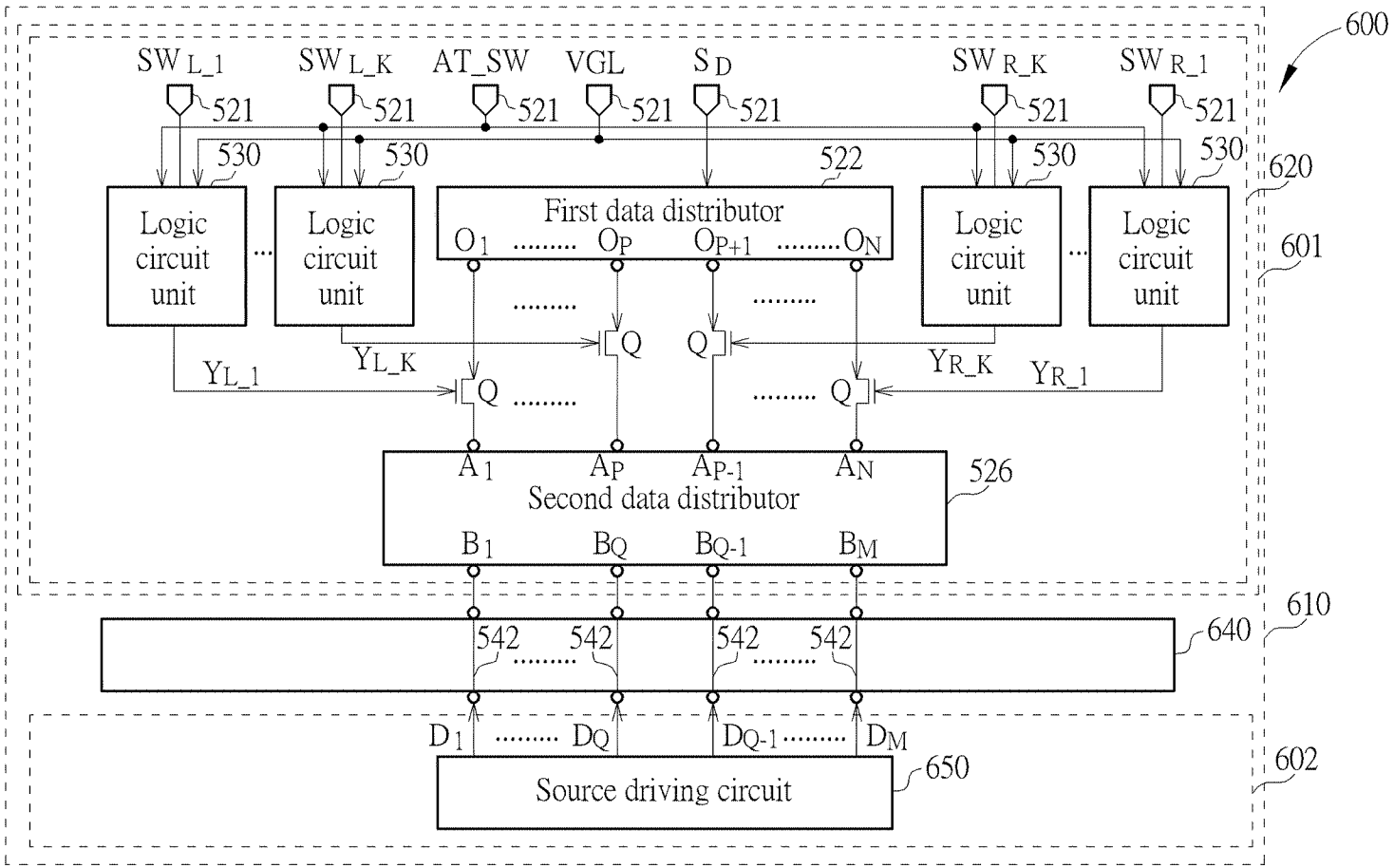
FIG. 10 is a schematic diagram of a liquid crystal display according to another embodiment of the present invention.

Please refer to FIG. 10. FIG. 10 is a schematic diagram of a liquid crystal display 600 according to another embodiment of the present invention. The major difference between the LCDs 600 and 500 is that the LCD 600 further comprises a second data distributor 526. The test data signal $S_D$ is distributed through the first data distributor 522 and the second data distributor 526 to the data lines 542 of the pixel array 640. In the embodiment, the resolution of the pixel array 640 is greater than that of the pixel array 640. In detail the LCD 600 comprises a substrate 610, the pixel array 640, a test circuit 620 and a source driving circuit 650. The test circuit 620 is positioned within a first area 601 of the substrate 610, the source driving circuit 650 is positioned within a second area 602 of the substrate 610, and the pixel array 640 is positioned between the first area 601 and the second area 602. The pixel array 640 comprises M data lines 542, and M is a positive integer greater than N. The second data distributor 526 comprises N input ends $A_1$ to $A_N$ and M output ends $B_1$ to $B_M$. Each of the input ends $A_1$ to $A_N$ of the second data distributor 526 is coupled to one of the N switches Q, and each of the output ends $B_1$ to $B_M$ of the second data distributor 526 is coupled to one of data lines 542 of the LCD 600. The second data distributor 526 is configured to selectively distribute the test data signal $S_D$ from the N input ends $A_1$ to $A_N$ to the M output ends $B_1$ to $B_M$. Therefore, the second data distributor 526 is basically an N-to-M multiplexer. Furthermore, since M is greater than N, the test circuit 620 is capable of testing the pixel array 640 that has a greater resolution than the pixel array 540 tested by the test circuit 520. Accordingly, as compared to the test circuit 520, the test circuit 620 is more suitable for testing a pixel array having a high resolution.

Further, the source driving circuit 650 is configured to generate operational data signals $D_1$ to $D_M$ and output the operational data signals $D_1$ to $D_N$ to the pixels 546 of the pixel array 640 via the data lines 542. It is noted that the operations of the source driving circuit 650 do not conflict with the operations of the test circuit 620 because the test circuit 620 performs array tests on the thin film transistors of the LCD 600 during manufacturing the LCD 600 and would be disabled while the manufacture of the LCD 600 is finished. Moreover, the source driving circuit 650 is configured to generate the operational data signals $D_1$ to $D_M$ after the manufacture of the LCD 600 is done. For the aforesaid reasons, the operations of the source driving circuit 650 do not conflict with the operations of the test circuit 620.

The test circuit of the LCD according to the present invention uses no wire routing from the first area to the second area, such that the pixels of the pixel array would operate normally even if the width to length ratio (i.e. W/L) of the switches Q is not increased painstakingly. Therefore, the bezels of the LCD located between the first area and the second area would be narrowed, and each switch according to the present invention has a smaller layout area as compared to the prior art.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A test circuit of a liquid crystal display (LCD), the test circuit comprising:

a plurality of signal pads, comprising:

a test signal pad, configured to receive a test data signal;

a voltage level signal pad, configured to receive a voltage level signal;

an enable signal pad, configured to receive an enable signal; and a plurality of switch control signal pad, each configured to correspondingly receive one of a plurality of first switch control signals;

a first data distributor, coupled to the test signal pad, and configured to receive the test data signal from the test signal pad; and selectively distribute the test data signal to N output ends of the first data distributor, wherein N is a positive integer;

a plurality of logic circuit units, each coupled to the voltage level signal pad, the enable signal pad and a corresponding switch control signal pad, and each configured to receive the voltage level signal, the enable signal and a corresponding one of the first switch control signals from the voltage level signal pad, the enable signal pad and the corresponding switch control signal pad, respectively; and generate a second switch control signal according to the voltage level signal, the enable signal and the corresponding first switch control signal;

N switches, each coupled to a corresponding one of the logic circuit units and between a corresponding output end of the first data distributor and at least one data line of the LCD, and configured to receive the second switch control signal from the corresponding logic circuit unit; and control electrical connection between the corresponding output end of the first data distributor and the at least one data line coupled to the corresponding output according to the second switch control signal; and a second data distributor having N input ends and M output ends, wherein M is a positive integer greater than N, each of the input ends of the second data distributor is coupled to one of the N switches, each of the output ends of the second data distributor is coupled to one of data lines of the LCD, and the second data distributor is configured to selectively distribute the test data signal from the N input ends to the M output ends.

2. The test circuit of claim 1, wherein the LCD further comprises:

a substrate;

a pixel array, formed on the substrate and comprising:

a plurality of pixels, arranged as an array; and a plurality of data lines, coupled to the pixels; and a source driving circuit, configured to generate operational data signals and output the operational data signals to the pixels;

wherein the test circuit is positioned only within a first area of the substrate, the source driving circuit is positioned within a second area of the substrate, the first area does not overlap the second area, and the pixel array is positioned between the first area and the second area.

3. The test circuit of claim 1, wherein the signal pads are further configured to receive a control signal, and each of the logic circuit units generates the second switch control signal according to the control signal, the voltage level signal, the enable signal and a corresponding one of the first switch control signals received from the signal pads.

4. The test circuit of claim 3, wherein the enable signal is switched between a first level and a second level such that the second switch control signal generated by the each of the logic circuit units is the first switch control signal or the control signal.

5. The test circuit of claim 1, wherein the enable signal is switched between a first level and a second level such that the second switch control signal generated by the each of the logic circuit units is the first switch control signal or the voltage level signal.

6. The test circuit of claim 1, wherein each of the logic circuit units comprises a plurality of transistors, and each of the transistors is an NPN-type transistor.

7. A liquid crystal display (LCD), comprising:

a substrate;

a pixel array, formed on the substrate and comprising:

a plurality of pixels, arranged as an array; and a plurality of data lines, coupled to the pixels;

a test circuit, comprising:

a plurality of signal pads, comprising:

a test signal pad, configured to receive a test data signal;

a voltage level signal pad, configured to receive a voltage level signal;

an enable signal pad, configured to receive an enable signal; and a plurality of switch control signal pad, each configured to correspondingly receive one of a plurality of first switch control signals;

a first data distributor, coupled to the test signal pad, and configured to receive the test data signal from the test signal pad; and selectively distribute the test data signal to N output ends of the first data distributor, wherein N is a positive integer;

a plurality of logic circuit units, each coupled to the voltage level signal pad, the enable signal pad and a corresponding switch control signal pad, and each configured to receive the voltage level signal, the enable signal and a corresponding one of the first switch control signals from the voltage level signal pad, the enable signal pad and the corresponding switch control signal pad, respectively; and generate a second switch control signal according to the voltage level signal, the enable signal and the corresponding first switch control signal;

N switches, each coupled to a corresponding one of the logic circuit units and between a corresponding output end of the first data distributor and at least one of the data lines of the LCD, and configured to receive the second switch control signal from the corresponding logic circuit unit; and control electrical connection between the corresponding output end of the first data distributor and the at least one data line coupled to the corresponding output according to the second switch control signal; and a second data distributor having N input ends and M output ends, wherein M is a positive integer greater than N, each of the input ends of the second data distributor is coupled to one of the N switches, each of the output ends of the second data distributor is coupled to one of data lines of the LCD, and the second data distributor is configured to selectively distribute the test data signal from the N input ends to the M output ends; and a source driving circuit, configured to generate operational data signals and output the operational data signals to the pixels.

8. The LCD of claim 7, wherein the test circuit is only positioned within a first area of the substrate, the source driving circuit is positioned within a second area of the substrate, the first area does not overlap the second area, and the pixel array is positioned between the first area and the second area.

9. The LCD of claim 7, wherein the signal pads are further configured to receive a control signal, and each of the logic circuit units generates the second switch control signal according to the control signal, the voltage level signal, the enable signal and a corresponding one of the first switch control signals received from the signal pads.

10. The LCD of claim 9, wherein the enable signal is switched between a first level and a second level such that the second switch control signal generated by the each of the logic circuit units is the first switch control signal or the control signal.

11. The LCD of claim 7, wherein the enable signal is switched between a first level and a second level such that the second switch control signal generated by the each of the logic circuit units is the first switch control signal or the voltage level signal.

12. The LCD of claim 7, wherein each of the logic circuit units comprises a plurality of transistors, and each of the transistors is an NPN-type transistor.

* * * * *